United States Patent [19]

Strangfeld

[11] 4,176,821

[45] Dec. 4, 1979

[54] PILOT-OPERATED VALVE ASSEMBLY

[75] Inventor: Reiner Strangfeld, Minden -Leteln, Fed. Rep. of Germany

[73] Assignee: Georg Rost & Söhne, Porta Westfalica, Fed. Rep. of Germany

[21] Appl. No.: 950,691

[22] Filed: Oct. 12, 1978

Related U.S. Application Data

[63] Continuation of Ser. No. 774,428, Mar. 4, 1977, abandoned.

[30] Foreign Application Priority Data

Mar. 5, 1976 [DE] Fed. Rep. of Germany ..... 2609138

[51] Int. Cl.[2] ..... F16K 31/12; E03D 1/35; F16K 51/00

[52] U.S. Cl. ..... 251/38; 251/144; 4/203

[58] Field of Search ..... 251/38, 144; 4/29, 30

[56] References Cited

U.S. PATENT DOCUMENTS

| | | | |
|---|---|---|---|
| 3,677,294 | 7/1972 | Gibbs et al. | 4/26 X |
| 3,817,279 | 6/1974 | Larson | 251/144 X |
| 3,817,286 | 6/1974 | Caron et al. | 4/29 X |
| 3,817,489 | 6/1974 | Caron et al. | 251/38 |
| 3,820,754 | 6/1974 | Caron et al. | 251/38 |

*Primary Examiner*—Martin P. Schwadron
*Assistant Examiner*—A. Michael Chambers
*Attorney, Agent, or Firm*—Peter K. Kontler

[57] ABSTRACT

A valve assembly for evacuation of liquids from vessels of the type having a bottom wall provided with an outlet opening has a buoyant piston which forms part of a main valve and is movable to and from a closed position in which a sealing ring of the piston engages an annular seat surrounding the outlet opening. The upper surface of the piston is located below a liquid column in the chamber of a vertically movable housing having a valve member defining with a second sealing ring of the piston an auxiliary valve which is opened in response to depression of the housing to thus connect the chamber with the outlet opening whereby the pressure of the liquid in the chamber decreases. The difference of the pressure between the bottom of the vessel and the chamber pushes the piston upwardly because the effective area of the upper surface of the piston is larger than the effective area of its seat. Such upward movement is enhanced by the buoyancy of the piston. In its raised position, the piston permits the liquid to flow from the interior of the vessel into the outlet opening. The cross-sectional area of the path which the auxiliary valve defines for the flow of liquid from the chamber increases in response to movement of the piston from the closed position. The piston is returned to closed position by gravity when the vessel is empty and the liquid which normally fills a receptacle in the upper part of the housing has been evacuated from the receptacle by way of an orifice in the housing, thereby interrrupting the buoyancy of the piston.

19 Claims, 2 Drawing Figures

PILOT-OPERATED VALVE ASSEMBLY

This is a continuation of application Ser. No. 774,428, filed Mar. 4, 1977, now abandoned.

BACKGROUND OF THE INVENTION

The present invention relates to apparatus for regulating the flow of liquids through the outlet openings of sinks, tanks or other types of vessels. More particularly, the invention relates to improvements in valve assemblies which can be utilized to regulate the outflow of liquids through outlet openings provided in the bottom walls or liquid-containing or storing vessels.

Heretofore known valve assemblies which are used for the above outlined purpose comprise a valve element which is movable up and down between open and closed positions with respect to an annular seat surrounding the outlet opening in the bottom wall of the liquid-containing vessel. The upward movement of the valve element can be effected by means of a rod which is to be raised (pulled) in order to lift the valve element off the seat. It is also known to employ an actuating device which must be depressed in order to lift the valve element off the seat; this necessitates the provision of a linkage which moves the valve element upwardly in response to downward movement of the actuating device.

A drawback of the aforedescribed valve assemblies is that, in order to initiate the outflow of liquid, it is necessary to apply a rather pronounced force which is required to lift the valve element against the static pressure of the liquid column thereabove, especially if the level of liquid in the vessel is high.

SUMMARY OF THE INVENTION

An object of the invention is to provide a valve assembly which can be used to regulate or control the outflow of liquids from vessels and which is constructed and assembled in such a way that opening of the main valve necessitates the exertion of a surprisingly small force.

Another object of the invention is to provide a novel and improved auxiliary valve or pilot valve for use in the valve assembly of the just outlined character.

A further object of the invention is to provide a relatively simple, rugged, inexpensive and compact valve assembly which can be utilized as a superior substitute for existing conventional valve assemblies.

An additional object of the invention is to provide a valve assembly whose useful life is much longer than the useful life of heretofore known valve assemblies, which requires a minimum of maintenance, which can be assembled or taken apart with little loss in time, and whose main valve closes automatically when the piston returns to its lower position by gravity.

An ancillary object of the invention is to provide a novel valve body and a novel valve element for use in the above outlined valve assembly.

The invention is embodied in a valve assembly for evacuation of liquids from vessels of the type including a bottom wall having an outlet opening for liquid and a seat surrounding the outlet opening. The valve assembly comprises a main valve including the seat of the vessel and a preferably piston-like buoyant valve element which is movable up and down between open and closed positions in which the valve element is respectively remote from and engages the seat, a preferably bell-shaped housing defining with the valve element a liquid-containing chamber above the upper surface of the valve element so that the static pressure of the liquid column in the chamber urges the valve element to the closed position, and an auxiliary or pilot valve which is actuatable to open a path for the flow of liquid from the chamber into the outlet opening and to thus reduce the pressure of the liquid in the chamber whereby the difference of the pressure between the bottom of the vessel and the chamber pushes the piston upwardly because the effective area of the upper surface of the piston is larger than the effective area of the seat. Such upward movement is enhanced by the buoyancy of the piston. In its raised position, the piston permits the liquid to flow from the interior of the vessel into the outlet opening. The buoyancy of the valve element is attributable to the provision of one or more gas-containing compartments in the valve element and/or the provision of resilient or other suitable means which urges the valve element from the closed position with a predetermined force.

The actuating means for the auxiliary valve preferably includes a portion of the housing; such portion preferably extends upwardly above the chamber and from the vessel so that it can be depressed from without the vessel. The housing preferably shares the movements of the actuating means, and the valve assembly preferably further comprises means for limiting the extent of movement of the housing relative to the vessel.

The novel features which are considered as characteristic of the invention are set forth in particular in the appended claims. The improved valve assembly itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
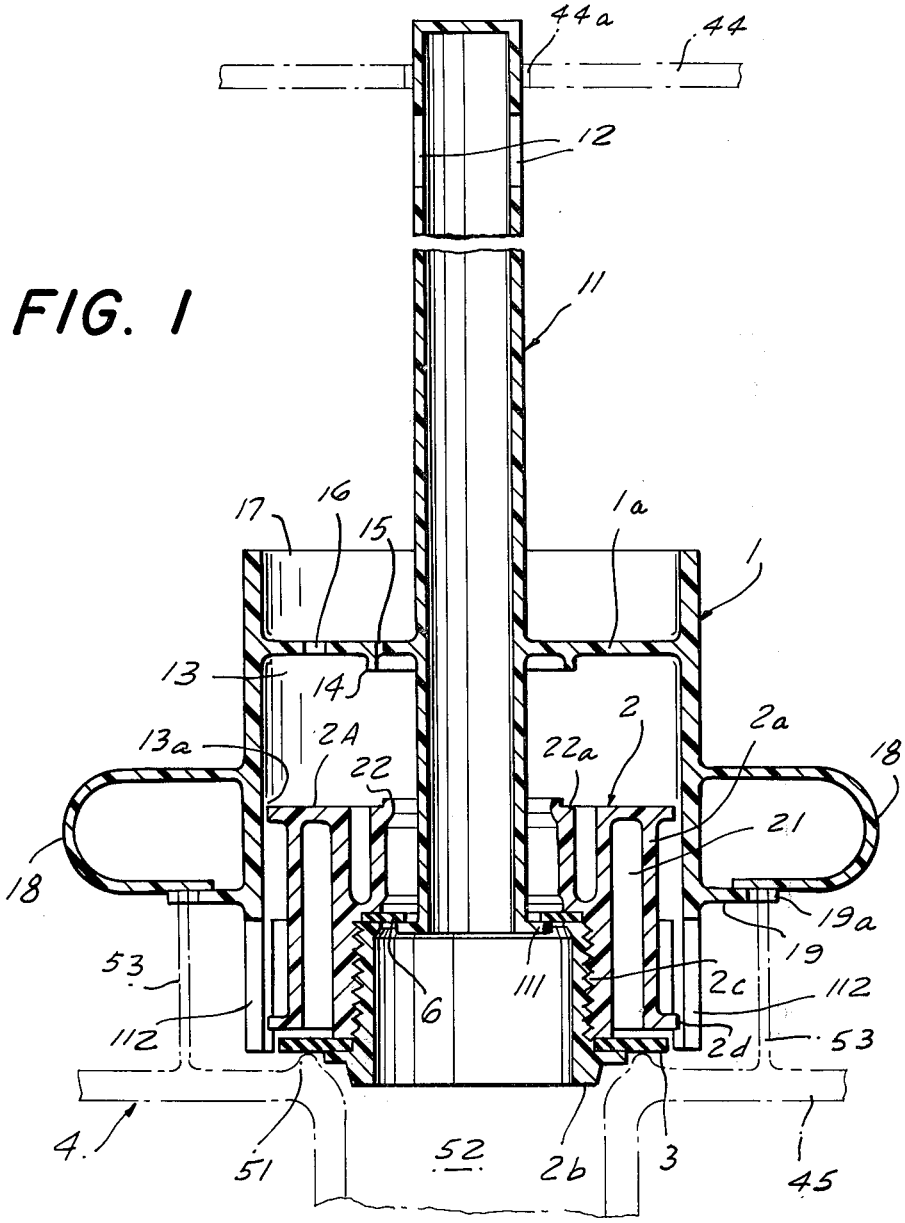
FIG. 1 is an axial sectional view of a valve assembly which embodies one form of the invention, the valve element of the main valve being shown in the closed position and a portion of the liquid-receiving vessel being indicated by phantom lines.

FIG. 1 shows a valve assembly which embodies the present invention and is installed in a vessel 4 having a top wall 44 and a bottom wall 45 provided with an outlet opening 52 which is surrounded by an annular valve seat 51. The vessel 4 may serve for temporary storage of water, e.g., to be used for flushing a toilet bowl in a manner not forming part of the invention. Still further, the vessel is provided with an inlet (not shown) which admits water or another liquid and is controlled by a suitable flow regulating or shutoff valve.

The improved valve assembly includes two main components, namely a bell-shaped body or housing 1 and a piston- or plunger-shaped valve element 2 which is installed in the housing 1. The valve element 2 is provided with an annular sealing member 3 which normally engages the seat 51. The parts 2–3 and 51 can be said to constitute the main or primary valve of the valve assembly. A secondary or auxiliary valve of the valve assembly includes an annular sealing member 6 which can be said to constitute a component part of the valve element 2 as well as the seat member of the auxiliary valve. The auxiliary valve further comprises a tubular actuating device 11 (hereinafter called tube for short) which is rigid and preferably (but not necessarily) integral with the housing 1. The upper portion of the tube 11 extends through an opening 44*a* of the top wall 44 of the vessel 4 so that it can be depressed by hand or by an object from without the vessel in order to open the auxiliary valve. The lower end portion of the tube 11 has a valve member here shown as an outwardly extending annular collar or extension 111 which abuts against the underside of the sealing member or seat member 6 when the auxiliary valve is closed. The radially outermost portion of the sealing member 6 is clamped between two sections 2*a*, 2*b* of the valve element 2, and such sections are threadedly connected to each other, as at 2*c*.

The tube 11 is located centrally of the housing 1 and its axis is preferably vertical. As shown, the lower end of the tube 11 (such lower end is surrounded by the collar 111) is open so that the interior of the tube is in permanent communication with the outlet opening 52 of the vessel 4. The cylindrical wall of the tube 11 has one or more ports 12 which are disposed at a level above the main portion of the housing 1 and serve as overflow openings which admit liquid from the interior of the vessel 4 into the outlet opening 52 even if the two valves of the valve assembly are closed. The need for the overflow of surplus liquid might arise if the aforementioned valve in the inlet of the vessel 4 leaks and allows excessive quantities of liquid to enter the space above the bottom wall 45.

The valve element 2 has an open underside and is installed with limited freedom of axial movement in the interior of the housing 1. The outer diameter of the valve element 2 is slightly less than the internal diameter of the surrounding circumferentially complete portion of the housing 1 so that the lower end of a cylindrical chamber 13 of the housing 1 is in permanent communication with the interior of the vessel 1. The chamber 13 receives the valve element 2 and its annular marginal portion extends all the way to the lower end of the housing 1. The narrowest annular clearance between the valve element 2 and the surface surrounding the chamber 13 is shown at 13*a*. The outer section 2*a* of the valve element 2 is formed with an annular gas-containing compartment 21 whose lower end is open and is located at a level above and spaced apart from the sealing member 3.

Figure 2:
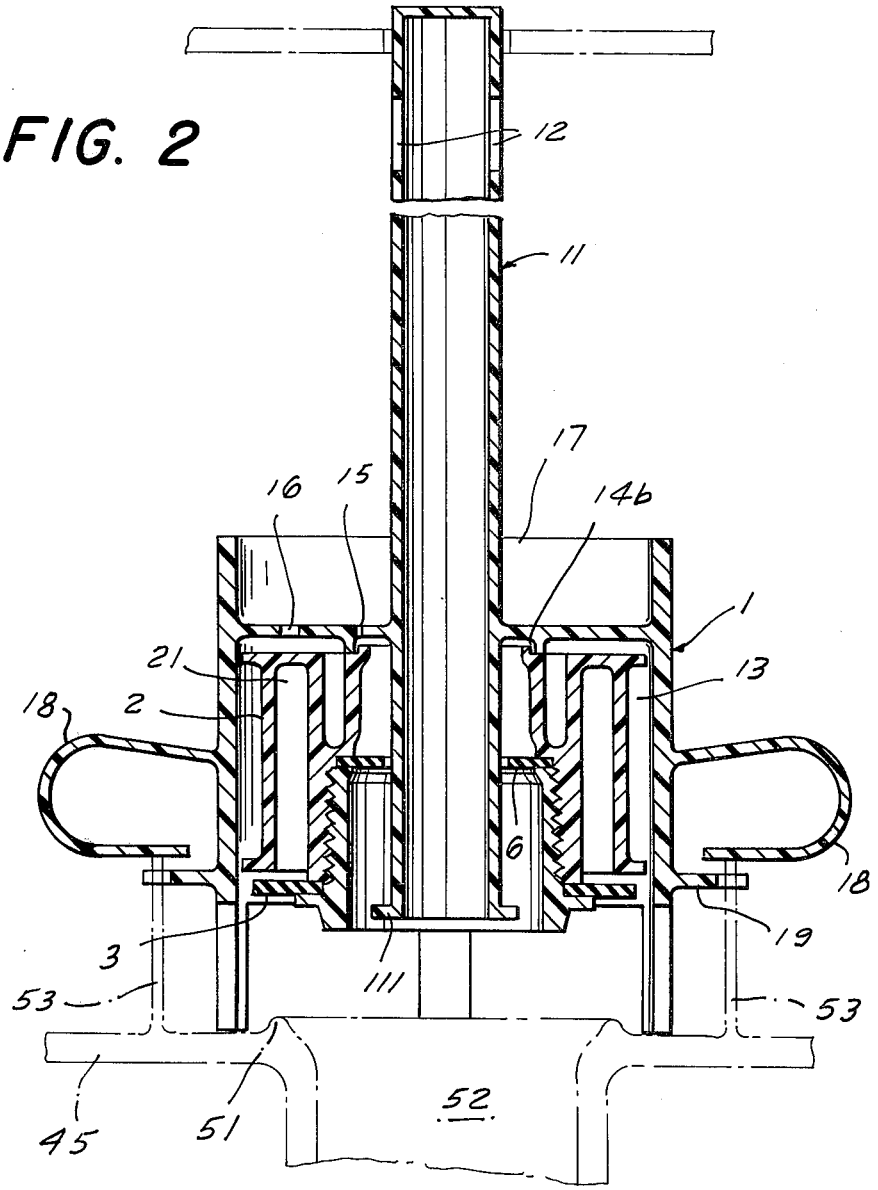
FIG. 2 illustrates the structure of FIG. 1, but with the valve element of the main valve shown in open position.

The upper portion of the outer section 2*a* of the valve element 2 has an upwardly annular projection 22 which is concentric with the tube 11 and is in register with a downwardly extending annular projection 14 in a horizontal partition 1*a* of the housing 1 at a level above the valve element 2. When the valve element 2 is moved from the closed position of FIG. 1 to the fully open position of FIG. 2, the projection 22 abuts against or is surrounded by the projection 14; in the latter instance (and as shown in FIG. 2), the lower edge face of the projection 14 abuts against an annular shoulder 22*a* which surrounds the projection 22.

The partition 1*a* of the housing 1 is formed with at least one orifice 15 which is located within the confines of the projection 14, and with at least one second orifice 16 which is remote from the projection 14, as considered in the radial direction of the housing 1.

The partition 1*a* constitutes the bottom of a cylindrical, cupped or otherwise configurated receptacle 17. The upper end of the receptacle 17 is open so that the receptacle is normally filled with liquid which is confined in the vessel 4.

The housing 1 is provided with or connected to one or more external elastic arms 18 here shown as arcuate integral portions of the housing. When the valves of the valve assembly are closed, the free end portions of the arms 18 rest on outwardly extending portions or stops 19 of the main portion of the housing 1. The portions or stops 19 may constitute to form part of a circumferentially complete annular ledge of the cylindrical wall of the housing 1. Such ledge has a slot or an otherwise configurated aperture 19*a* in register with each of the arms 18, and each aperture 19*a* is further in register with one of several upwardly extending supporting posts or columns 53 provided on the bottom wall 45 of the vessel 4. When the valves of the valve assembly are closed, the arms 18 rest on the upper end portions of the respective posts 53. The extent to which the housing 1 is movable downwardly toward the bottom wall 45 of the vessel 4 is limited by legs or stops 112 which extend downwardly from the cylindrical main wall of the housing and come into abutment with the bottom wall 45 when the housing 1 reaches the position shown in FIG. 2. The internal surfaces of the legs 112 (which are spaced apart from each other, as considered in the circumferential direction of the housing 1) preferably also serve as a means for guiding the adjacent external flange 2*d* of the valve element 2.

The arms 18 store energy when the tube 11 is depressed and tend to lift the housing 1 to the upper end position of FIG. 1 in which their free ends abut the respective stops 19.

The operation:

When the vessel 4 is filled with a liquid, the main valve 2–3, 51 is closed (see FIG. 1) by the gravity of the valve element 2 and also by the column of liquid which rests on the valve element. The free end portions of elastic arms 18 rest on the upper side of the ledge 19, thus supporting the housing 1 on the posts 53.

If the liquid is to be evacuated from the vessel 4, slight finger pressure, hand pressure or pressure through the medium of an object is applied against the upper end face of the tube 11 for a short interval of time. Since the housing 1 is rigid with the tube 11, the housing descends in response to downward movement of the tube whereby the ledge 19 also descends and the free extremities of the arms 18 are lifted off the ledge by the respective posts 53 (see FIG. 2). As the tube 11 descends in response to application of pressure against its upper end face, the collar 111 moves away from the sealing member 6, i.e., the auxiliary valve defines a path which allows liquid to flow from the chamber 13 into the outlet opening 52. This causes the pressure in the chamber 13 to decrease and the higher pressure at the bottom of the vessel 4 moves the valve element 2 upwardly. Such upward movement of the valve element 2 is supported by its buoyancy because the chambers 21 are filled with air. Thus, the sealing member 3 moves away from the seat 51 and allows the liquid to flow rapidly out of the interior of the vessel 4.

The valve element 2 remains in the raised position of FIG. 2 as long as the receptacle 17 contains some liquid. Such liquid flows into the chamber 13 via orifice 16. When the receptacle 17 is empty, i.e., when the orifice 16 begins to admit air, the pressure at the upper side of the valve element 2 equals the presusre at its underside and the valve element descends by gravity to return the sealing member 3 into engagement with the seat 51, i.e., the main valve is closed again. The just described delayed closing of the main valve insures evacuation of the entire body of liquid from the vessel 4 before the member 3 returns into sealing engagement with the seat 51.

The annular channel 14*b* between the projections 14 and 22 is always filled with water when the valve element 2 dwells in the open or raised position of FIG. 2 because this channel receives liquid from the receptacle 17 via orifice 15. This insures that eventual tolerances in the machining or other mode of making the parts 1 and 2 cannot result in uncontrolled or premature admission of air into the chamber 13, i.e., in premature descent of valve element 2 back to the closed position of FIG. 1 (before the entire body of liquid leaves the vessel 4).

An important advantage of the improved valve assembly is that the actuation of auxiliary valve or pilot valve 6, 111 necessitates the exertion of a relatively small force. The main valve opens automatically as soon as the static pressure of the column of liquid in the chamber 13 decreases sufficiently to allow the valve element 2 to move upwardly and away from the seat 51. The effective area of the upper surface 2A of the valve element 2 (in the chamber 13) is larger than the effective area of the seat 51. Once the auxiliary valve has been opened in response to downward movement of the tube 11, the cross-sectional area of the path which the auxiliary valve defines for the flow of liquid from the chamber 13 into the outlet 52 (via tube 11) does not decrease, and the cross-sectional area of such path increases as soon as the valve element 2 is lifted off the seat 51. This is due to the fact that the direction of (downward) movement of the tube 11 and its valve member or collar 111 toward the open position of the valve member 111 is counter to the direction of (upward) movement of the valve element 2 toward its open position. In other words, the rate of liquid flow through the auxiliary valve automatically increases in response to opening of the main valve. This insures a self-holding action of the auxiliary valve, i.e., the auxiliary valve remains open as long as the main valve allows the liquid to flow from the vessel 4 and directly into the outlet opening 52.

In the illustrated embodiment, the main components 1 and 2 of the valve assembly consist of a suitable synthetic plastic material. It is clear, however, that at least one of these parts may be made of metal or any other suitable material. Also, the tube 11 and/or the arms 18 and ledge 19 need not constitute integral parts of the housing 1, and the valve element 2 may be made of a single piece of metallic, synthetic plastic or other material. The buoyancy of the valve element 2 can be enhanced by resorting to one or more resilient elements or the like.

The improved valve assembly is susceptible of many modifications without departing from the spirit of the invention. For example, the housing 1 can be biased upwardly by one or more helical springs or other resilient means, by one or more air chambers in the body of the housing or by a combination of such features. All that counts is to insure that the buoyancy of the housing (under the action of a fluid medium, with the assistance from one or more resilient elements, or by both) is sufficient to insure that the housing reassumes the position of FIG. 1 when the liquid is evacuated from the vessel 4.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

What is claimed is:

1. A valve assembly for evacuation of liquids from low pressure vessels of the type including a bottom wall having an outlet opening and a seat surrounding said opening, comprising a main valve including said seat and a buoyant valve element movable up and down between open and closed positions in which a portion of said element is respectively remote from and sealingly engages said seat, said element having an upper surface; a housing defining with said element a liquid-receiving chamber above said upper surface so that the static pressure of the column and having inlet means to allow the flow of liquid into said chamber in said chamber urges said element to said closed position, the buoyancy of said element being such that said element moves and floats from said closed position, in the absence of application of liquid pressure in a direction to lift said element off said seat, when the height of said liquid column is reduced below a predetermined value; and a pilot valve means actuatable to allow the liquid to flow from said chamber into said outlet opening in said closed position of said element and to thus reduce the height of said liquid column below said predetermined value in response to the actuation of said pilot valve means.

2. A valve assembly as defined in claim 1, wherein said pilot valve means comprises a seat member and a valve member, one of said members being movable with said element and the other of said members being moved downwardly and away from said one member in response to actuation of said pilot valve means to thereby open said path between said chamber and said outlet opening, the cross-sectional area of said path increasing in response to movement of said one member away from said other member as a result of movement of said valve element from said closed position.

3. A valve assembly as defined in claim 1, wherein said housing has an open underside and is movable up and down in said vessel, said housing comprising actuating means for said pilot valve means and said actuating means extending upwardly from said chamber and being depressible to thereby open said pilot valve means whereby such opening of said pilot valve means entails a downward movement of said housing in said vessel.

4. A valve assembly as defined in claim 3, wherein said pilot valve means comprises a seat member provided on said valve element and a valve member provided on said actuating means and engaging said seat member from below in the closed position of said pilot valve means.

5. A valve assembly as defined in claim 4, wherein said actuating means is an upright tube having an open lower end in communication with said outlet opening and said valve member is a collar surrounding said open lower end, said seat member including an annular sealing element mounted in said valve element.

6. A valve assembly as defined in claim 1, wherein said housing comprises a wall above said chamber and said wall comprises a downwardly extending annular portion sealingly engaging said upper surface of said valve element in said open position of said valve element.

7. A valve assembly as defined in claim 1, wherein said valve element has at least one gas-containing compartment, the buoyancy of said valve element being determined, at least in part, by the gas in said compartment.

8. A valve assembly as defined in claim 7, wherein said compartment has an open lower end.

9. A valve assembly as defined in claim 1, wherein said housing is movable up and down in said vessel, and further comprising means for limiting the extent of movement of said housing relative to said vessel.

10. A valve assembly as defined in claim 9, wherein said limiting means includes at least one elastic member provided on said housing and at least one stop against which said elastic member abuts in the upper end position of said housing.

11. A valve assembly as defined in claim 10, wherein said stop is attached to said housing.

12. A valve assembly as defined in claim 10, wherein said limiting means further comprises at least one support provided in said vessel and located in the path of movement of said elastic member so that said elastic member is deformed and stores energy in response to movement of said housing from said upper end position.

13. A valve assembly as defined in claim 12, wherein said support is an upright post and said stop has an aperture for the upper end portion of said post.

14. A valve assembly as defined in claim 1, wherein said housing is movable in said vessel up and down and comprises at least one downwardly extending leg abutting against said vessel in the lower end position of said housing.

15. A valve assembly as defined in claim 14, wherein said leg comprises means for guiding said valve element during movement between said open and closed positions.

16. A valve assembly as defined in claim 1, wherein said housing further comprises an upwardly extending portion which is accessible from without said vessel and is depressible to thereby move said housing downwardly and to simultaneously open said pilot valve means.

17. A valve assembly as defined in claim 1, further comprising means for actuating said pilot valve means including an upright tube which is depressible from without said vessel and has an open lower end in communication with said outlet opening and at least one overflow opening in communication with the interior of said vessel at a level above said housing.

18. A valve assembly for evacuation of liquids from vessels of the type including a bottom wall having an outlet opening and a seat surrounding said opening, comprising a main valve including said seat and a buoyant valve element movable up and down between open and closed positions in which a portion of said element is respectively remote from and sealingly engages said seat, said element having an upper surface; a housing defining with said element a liquid-receiving chamber above said upper surface so that the static pressure of the liquid column in said chamber urges said element to said closed position; and an auxiliary valve actuatable to open a path for the flow of liquid from said chamber into said outlet opening, the surface of said valve element being larger than the effective area of said seat so that said element moves upwardly when the pressure of liquid in said chamber above said element is reduced on actuation of said auxiliary valve and the resulting opening of said path, said upward movement being assisted by the buoyancy of said valve element, said housing comprising a wall above said chamber and said wall comprising a downwardly extending annular portion sealingly engaging said upper surface of said valve element in said open position of said valve element, said housing including a liquid-receiving receptacle above said wall and said wall having at least one orifice within the confines of said portion of said wall to establish communication between said receptacle and said chamber.

19. A valve assembly as defined in claim 18, wherein said wall has at least one second orifice located outside of said portion thereof.

* * * * *